US007498916B2

(12) United States Patent
Feist et al.

(10) Patent No.: US 7,498,916 B2
(45) Date of Patent: Mar. 3, 2009

(54) HOLDER FOR A CHOKE COIL AND AN INDUCTIVE COMPONENT WITH THE HOLDER

(75) Inventors: Guenter Feist, Gingen/Fils (DE); Bernd Kohler, Heidenheim (DE)

(73) Assignee: EPCOS AG, Munich (DE)

( * ) Notice: Subject to any disclaimer, the term of this patent is extended or adjusted under 35 U.S.C. 154(b) by 202 days.

(21) Appl. No.: 11/701,977

(22) Filed: Feb. 2, 2007

(65) Prior Publication Data

US 2007/0202727 A1 Aug. 30, 2007

Related U.S. Application Data

(63) Continuation of application No. PCT/DE2005/001168, filed on Jul. 1, 2005.

(30) Foreign Application Priority Data

Aug. 4, 2004 (DE) ..... 10 2004 037 853

(51) Int. Cl.
*H01F 27/06* (2006.01)

(52) U.S. Cl. ..... 336/65

(58) Field of Classification Search ..... 336/65, 336/90–96, 205–206, 225, 229
See application file for complete search history.

(56) References Cited

U.S. PATENT DOCUMENTS

| | | | | |
|---|---|---|---|---|
| 3,846,725 | A | 11/1974 | Mears, Jr. | |
| 4,263,479 | A * | 4/1981 | Lange et al. | 178/46 |
| 4,342,976 | A | 8/1982 | Ryser | |
| 4,571,569 | A | 2/1986 | Scharl | |
| 4,833,436 | A | 5/1989 | Martin et al. | |
| 5,307,043 | A * | 4/1994 | Dvorak et al. | 336/174 |
| 5,942,964 | A | 8/1999 | Takeuchi | |
| 6,163,243 | A * | 12/2000 | Titus | 336/174 |

FOREIGN PATENT DOCUMENTS

| | | | |
|---|---|---|---|
| DE | 24 20 995 | B2 | 11/1974 |
| DE | 30 47 603 | A1 | 7/1982 |
| DE | 33 30 881 | A1 | 3/1985 |
| DE | 43 21 872 | A1 | 2/1995 |
| DE | 197 30 108 | C2 | 1/1998 |
| EP | 0 258 592 | A1 | 3/1988 |
| JP | 09260164 | A | 3/1996 |

* cited by examiner

*Primary Examiner*—Tuyen T. Nguyen
(74) *Attorney, Agent, or Firm*—Slater & Matsil, L.L.P.

(57) ABSTRACT

A holder holds a ring-core choke with two or more wire windings. The holder has opposing, hinged side lugs, each of which has an isolating device for isolating the wire windings. The side lugs can be fixed preferably essentially parallel to each other preferably by means of isolating devices.

20 Claims, 6 Drawing Sheets

HOLDER FOR A CHOKE COIL AND AN INDUCTIVE COMPONENT WITH THE HOLDER

This application is a continuation of co-pending International Application No. PCT/DE2005/001168, filed Jul. 1, 2005, which designated the United States and was not published in English, and which is based on German Application No. 10 2004 037 853.3, filed Aug. 4, 2004, both of which applications are incorporated herein by reference.

TECHNICAL FIELD

The invention relates, in one aspect, to a holder for a choke coil and in a further aspect to an inductor with the holder and a choke coil.

BACKGROUND

From the publication DE 3330881 A1, a holder for a ring-core choke is known. The holder represents an insulating plate with an attached device for electrical isolation between two choke windings. The ring choke coil is placed on the electrical-isolation device such that different windings are spatially separated from each other. The electrical-isolation device has bars. The outer end edges of the bars touch the ring core of the choke in a spring-like manner.

SUMMARY OF THE INVENTION

The objective of the invention is to specify a material-saving and space-saving holder, which provides for electrical isolation of the windings from one another at a ring core choke with several windings and which can be produced simply.

The invention specifies an electrically isolating holder for carrying a ring-core choke with a closed magnetic core (preferably a ring core or a ring core featuring a gap) and at least two wire windings. The holder has a center part and hinged side lugs connected to this part. The holder further has means for fixing the side lugs in the folded together state, the lugs being preferably arranged essentially parallel to one another in the folded together state. The side lugs each feature an isolating element, which is used for separating or electrically isolating the windings of the choke attached to different ring core sections.

The side lugs preferably are located opposite to one another and can be folded on both sides against the ring core.

Further embodiments of the invention relate to an inductive component with the holder and a ring-core choke, which has a ring core and at least two wire windings to be isolated from each other.

Embodiments of the invention have the advantage that the holder functions, in addition to the function as a sub-housing, simultaneously as electrical isolation between different wire windings. The holder accordingly can be produced in a material-saving way and simply, e.g., in an injection molding method.

In a preferred variant of the invention, all of the elements of the holder, i.e., the center part, the side lugs, the isolating bars are formed as one piece with optional attachment devices constructed therein. In another variant, the side lugs can be attached to the center part, e.g., by hooks.

The side lugs are preferably held parallel to each other by a part of the holder, e.g., by means of isolating elements.

Each isolating element preferably has at least two isolating bars. The length of the isolating bars of opposing side lugs is preferably selected so that they touch each other when the side lugs are folded together. The isolating bars are arranged on the inner side of the side lugs. The isolating lugs are pushed into the ring core opening, wherein the longitudinal axis of the isolating bars is preferably oriented parallel to the center axis of the ring-core choke. Preferably, the side edge or one area of the outer surface of the isolating bar touches the inner surface of the ring core in a spring-like way.

The opposing isolating bars can have corresponding attachment devices, e.g., clamping devices or latch devices, which are preferably formed in the isolating bars.

In the center part of the holder, preferably there are openings for the passage of the winding wires to form connection terminals. These openings are used to establish the lead wire spacing of the corresponding inductive component.

In the center part of the holder, openings for holding attachment elements, e.g., screws or attachment bolts, are also provided. By means of the attachment elements, the component can be fixed onto a circuit board. In the center part of the holder, preferably there is a recess for holding the ring-core choke.

In one variant of the invention, together with vertical walls, the side lugs can form half-shells, whose openings point towards each other in the folded-together state. Here, a housing is formed that surrounds the coil arranged therein, preferably on all sides, and therefore is suitable, in particular, for protection against electrical shock. The side lugs and the vertical walls preferably have an integral construction.

BRIEF DESCRIPTION OF THE DRAWINGS

Embodiments of the invention are explained in more detail below with reference to the embodiments and the associated figures. The figures show different embodiments of the invention with reference to schematic and not-true-to-scale representations. Identical or identically functioning parts are designated with the same reference symbols. Shown schematically are.

Figure 1A:
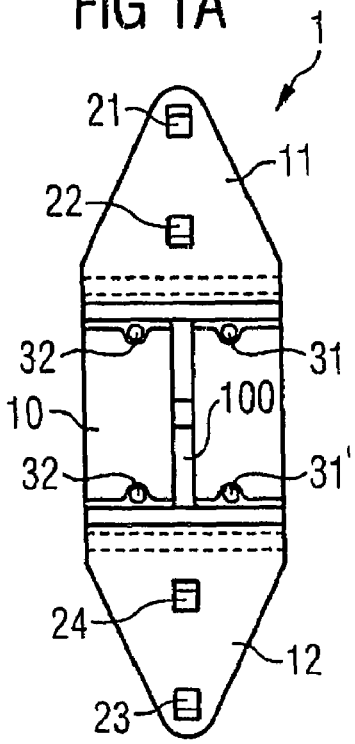
FIG. 1A, a top view of the holder according to the invention.

The following list of reference symbols can be used in conjunction with the figures:

| | |
|---|---|
| 1 | Holder |
| 10 | Center part of holder |
| 11 | First side lug of holder |
| 12 | Second side lug of holder |
| 100, 101 | Recess for holding the ring-core choke (recess or bulge) |
| 110 | End wall of first side lug 11 |
| 111 | Upward-turned wall of first side lug 11 |
| 120 | End wall of second side lug 12 |
| 121 | Upward-turned wall of second side lug 12 |
| 21, 22 | Isolating bars |
| 23, 24 | Isolating bars |
| 21a | Attachment device on isolating bar 21 |
| 23a | Attachment device on isolating bar 23 |
| 31, 31' | Openings for holding connections 52, 52' of wire winding 53a |
| 32, 32' | Openings for holding connections 51, 51' of wire winding 53b |
| 4 | Spacer |
| 5 | Ring-core choke |
| 51 | Connection of second wire winding 53b |
| 52, 52' | Connections of first wire winding 53a |
| 53a | First wire winding of ring-core choke 5 |
| 53b | Second wire winding of ring-core choke 5 |
| 54 | Magnetic ring core |

DETAILED DESCRIPTION OF ILLUSTRATIVE EMBODIMENTS

FIGS. 1A to 3B show different views of the first preferred embodiment of the holder 1 with a center part 10 and two opposing side lugs 11 and 12 connected to the center part 10.

In FIGS. 1A, 1B, 6B, and 6A, the state of the holder before folding the side lugs 11 and 12 over is indicated by the solid lines. In these figures, the dashed lines show the state of the holder 1 after the side lugs 11 and 12 are folded together.

Figure 1B:
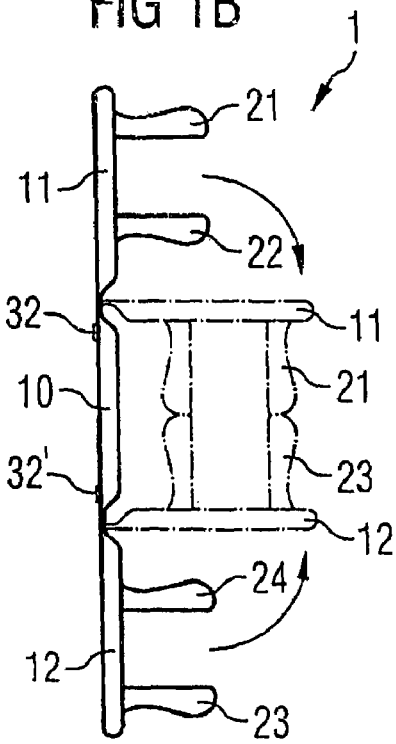
FIG. 1B, a side view of the holder according to FIG. 1A.

FIG. 1A shows a schematic top view of the holder 1. In FIG. 1B, the holder 1 is shown with the side lugs 11 and 12 folded together.

After being folded over, the side lugs 11 and 12 are essentially parallel to each other and perpendicular to the surface of the center part 10. A recess 100 for holding the ring-core choke 5 (see FIG. 4) is formed in the center part 10. The recess 100 preferably has a round cross section—see FIGS. 3A and 5B—and is adapted to the shape of the ring-core choke arranged therein.

Figure 4A:
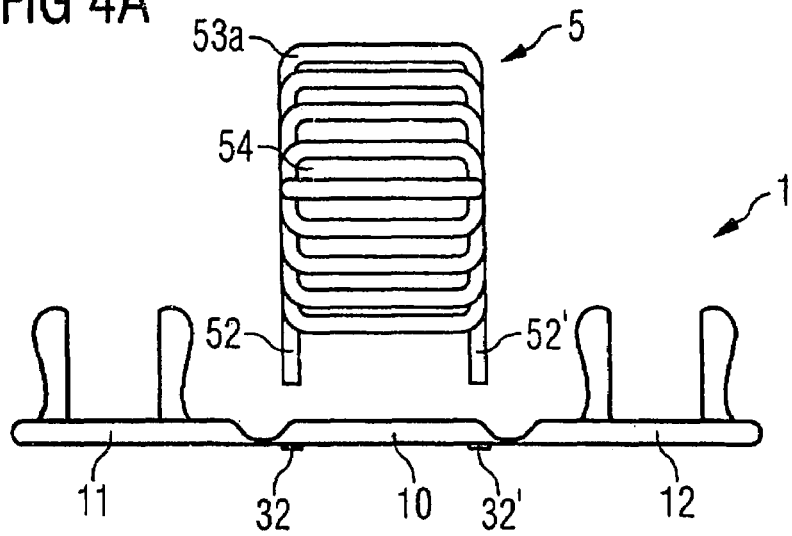
FIGS. 4A to 4D, the assembly steps for the assembly of a ring-core choke in the holder according to the preceding figures.
Figure 5A:
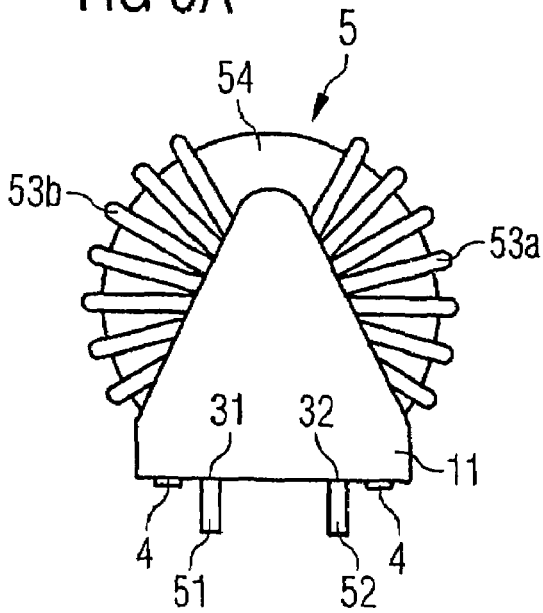
FIG. 5A, the inductive component with the holder according to the invention and the ring-core choke in a front view.
Figure 5B:
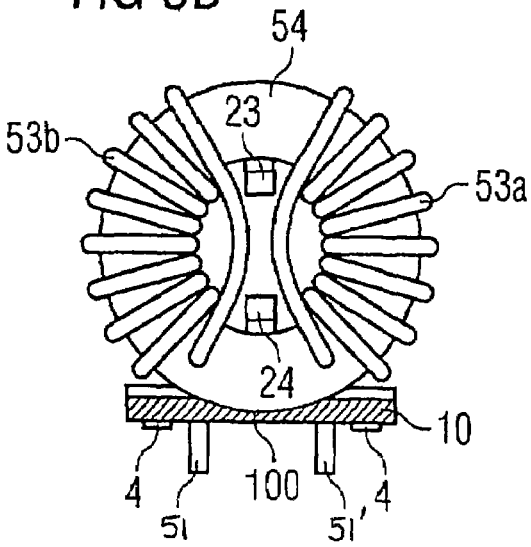
FIG. 5B, another view of the inductive component according to FIG. 5A from the inside.

In the center part 10, there are openings 32 and 32' for holding connections 52 and 52' of the first wire winding 53*a* of the ring-core choke 5 (also see FIGS. 4A and 5B). In addition, in the center part 10 there are openings 31 and 31' for holding connections 51 of a second wire winding 53*b* of the ring-core choke 5. The lead wire spacing of the corresponding inductive component with the ring-core choke 5 is guaranteed by the openings 31, 31', 32 and 32'.

Figure 1C:
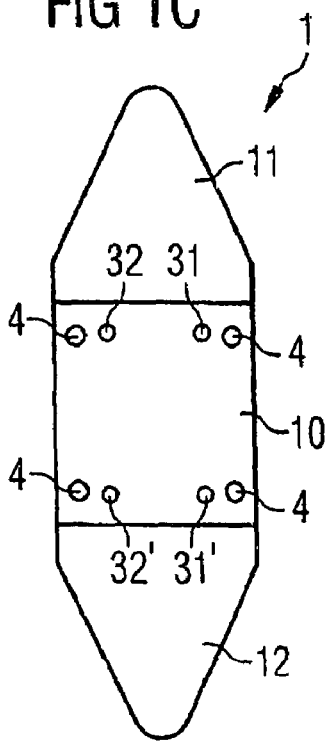
FIG. 1C, a bottom view of the holder for a choke coil according to FIGS. 1A and 1B.

In addition, as shown in FIG. 1C, spacers 4 are formed in the center part 10. These are used as distancing elements for maintaining a distance between the holder of the component and an underlying system carrier, e.g., circuit board, so that the gases generated during the soldering of the component to the printed conductors of the system carrier can escape. The spacers 4 can be formed as projections of the center part 10 of the holder. The spacers 4 can also be formed as separate elements and be rigidly connected to the center part 10.

The side lug 11 has isolating bars 21 and 22, as shown in FIG. 1B. The second side lug 12 also has isolating bars 23 and 24. The appropriate side lug 11 (or 12) and the isolating devices 21 and 22 (or 23 and 24) allocated to it are integrally formed together. The isolating bar 21 of the first side lug 11 corresponds to the isolating bar 23 of the second side lug 12. The isolating bar 22 corresponds to the isolating bar 24.

When the side lugs 11 and 12 are folded together, the isolating bars 21 and 23 (and also 22 and 24) are turned towards each other, preferably touching one another.

Figure 5C:
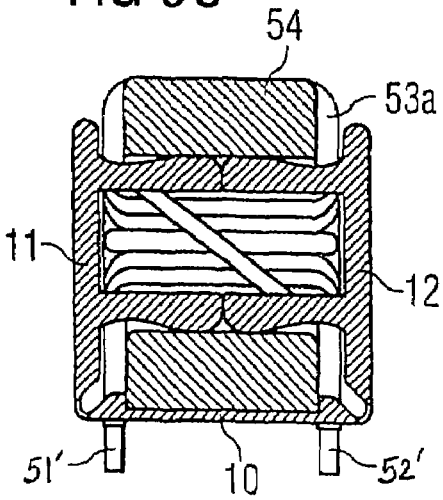
FIG. 5C, the inductive component according to FIGS. 5A and 5B in a schematic cross section perpendicular to the side lugs.

The adjacent wire windings 53*a* and 53*b* are held at a distance from each other by the isolating bars 21, 22, 23 and 24 and therefore are electrically isolated from each other; see FIG. 5C. Thus, the electrical isolation between the different wire windings 53*a* and 53*b* of the ring-core choke 5 is realized by the isolating bars 21 to 24.

Figure 2A:
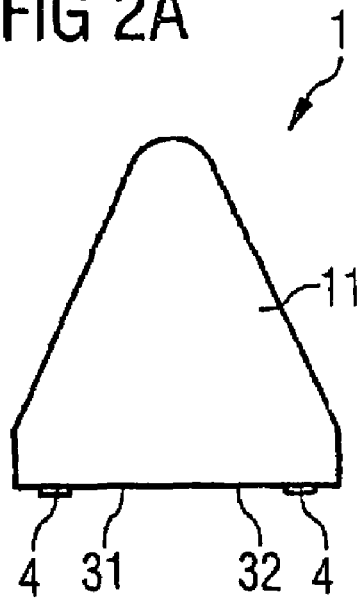
FIG. 2A, a front view of the holder according to the preceding figures in the direction perpendicular to the side lugs.
Figure 2B:
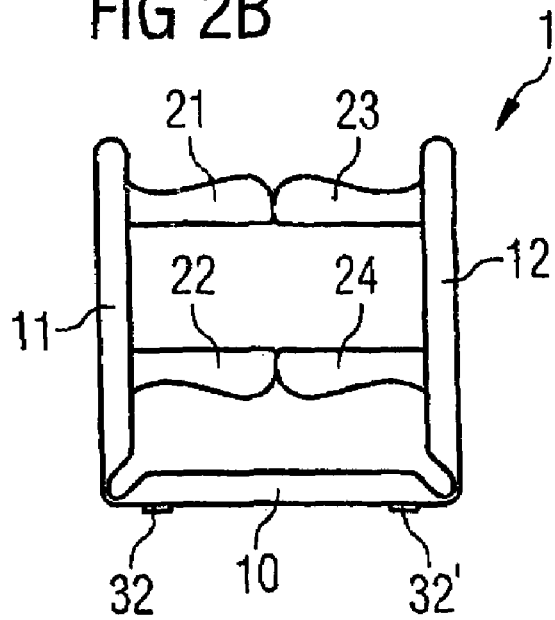
FIG. 2B, a side view of the holder in the direction parallel to the side lugs.

FIG. 1C shows the holder 1 in a schematic view from below. In FIG. 2A, the front view of the holder according to FIGS. 1A to 1C is shown perpendicular to the side lug 11. FIG. 2B shows a side view of the holder 1 for the side lugs 11 and 12 folded together in the direction parallel to the side lugs. FIG. 3B shows the corresponding cross-sectional view of the holder 1 for the cross section perpendicular to the side lugs.

Figure 3A:
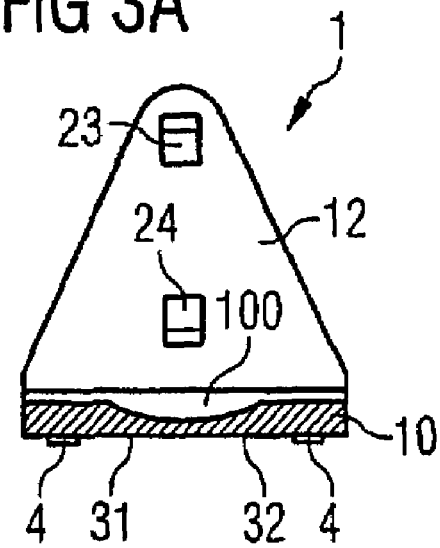
FIG. 3A, a cross section through the center part parallel to the side lugs with a view of a side lug from the inside for the holder according to the preceding figures.
Figure 3B:
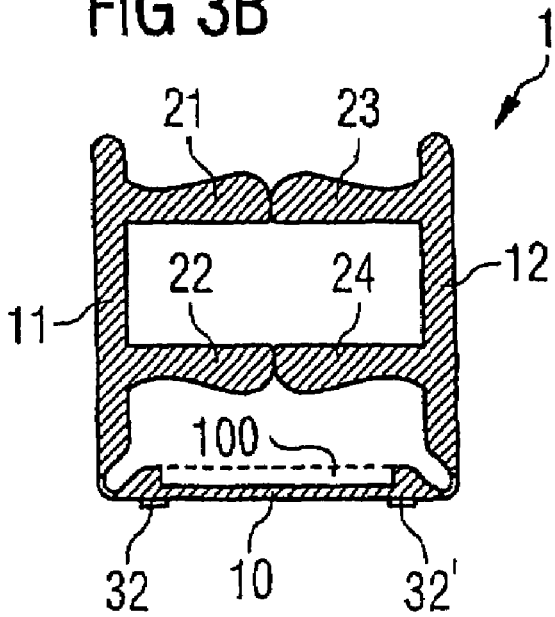
FIG. 3B, the holder according to the preceding figures in schematic cross section perpendicular to the side lugs.

FIG. 3A shows the cross section of the holder 1 through the center part 10 parallel to the side lugs 11 and 12 with the view of the folded side lug 12 from the inside.

In FIGS. 4A to 4D, processing steps for the assembly of a ring-core choke 5 in the holder 1 are shown schematically.

The ring-core choke 5 has a magnetic ring core 54 and also two different wire windings 53*a* and 53*b* (FIG. 4A, where only 53*a* is visible). In FIG. 5B, note that different wire windings 53*a* and 53*b* of the ring-core choke are placed on different sections of the ring core. The first wire winding 53*a* has the electrical connections 52 and 52'. The second wire winding 53*b* has the electrical connections 51 and 51'.

Figure 4B:
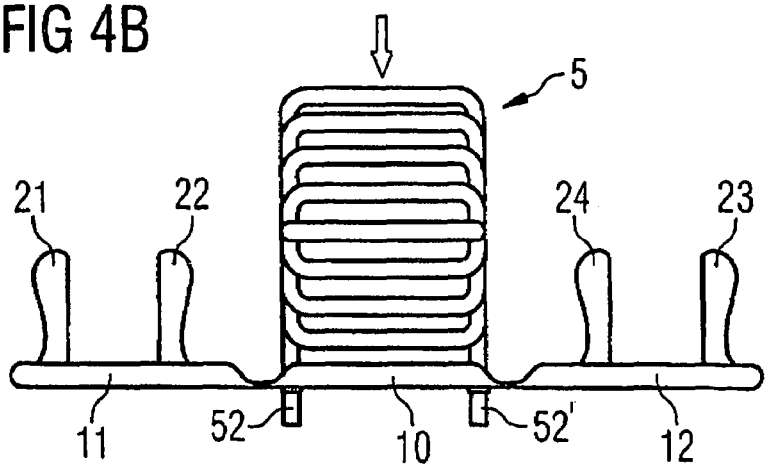

The connections 51, 51', 52 and 52' or the wire windings 53*a* and 53*b* are inserted through the openings 31, 32 and 32' of the center part 10 (FIG. 4B). The ring-core choke 5 is set with its outer surface on the center part 10 of the holder 1.

Figure 4C:
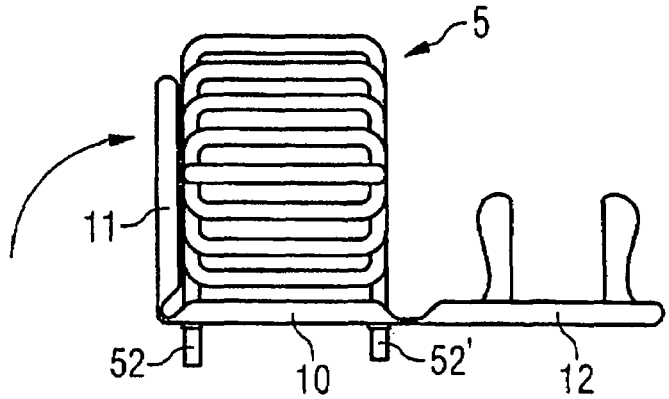

Then the first side lug 11 is folded against the end of the magnet core (FIG. 4C). Here, the isolating bars 21 and 22 are inserted into the inner hole of the magnet core, so that they touch the inner surface of the magnet core in a spring-like way.

Figure 4D:
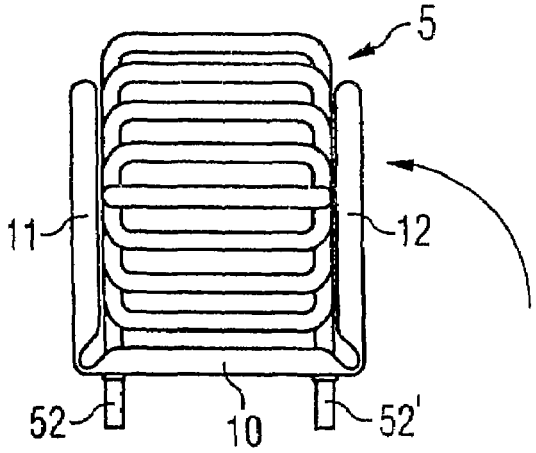

In FIG. 4D, it is shown that the second side lug 12 is folded against the ring-core choke. Here, the isolating bars 23 and 24 are inserted into the inner hole of the magnet core 54. They touch the inner surface of the magnet core in a spring-like way.

FIG. 4D shows the inductive component, i.e., the holder 1 with the ring-core choke 5 mounted thereon, in a schematic side view in the direction parallel to the side lugs 11 and 12. The front view of this component is shown in FIG. 5A.

A view of the inductive component from the inside is shown in FIG. 5B. The cross section of the recess 100 is adapted to the cross section of the magnet core 54. An adhesive, with which the magnet core 54 is fixed in the recess 100 of the holder 1, is preferably placed in the recess 100 before the ring-core choke 5 is inserted.

In FIG. 5C, the aforementioned inductive component is shown in a schematic cross section perpendicular to the side lugs 11 and 12.

Figure 7:
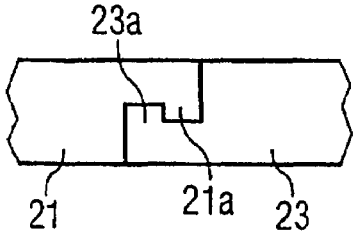
FIG. 7, the isolating bars with attachment devices.

The side lugs 11 and 12 are preferably held in the folded state parallel to each other by means of the isolating bars. The side lugs 11 and 12 can be held parallel to each other, e.g., by a press fit of the isolating bars 21 to 24 in the magnet core 54. Here, the isolating bars 21 to 24 are pushed into the inner hole of the magnet core 54, so that the isolating bars press against the inner surface of the magnet core. Another example possibility for fixing the side lugs when folded is shown in FIG. 7.

The ring-core choke 5 can be mounted on the holder 1 by means of an adhesive in the recess 100.

The isolating elements of the holder 1 are inserted into the center opening of the ring-core choke 5 and preferably touch the inner surface of the ring core 54 in a spring-like way.

The holder 1 according to FIGS. 1A to 3B forms a sub-housing of the inductive component. In FIGS. 6A to 6D, a second preferred embodiment of the holder according to the invention is shown. In this case, the holder 1 forms a complete housing of the inductive component.

Figure 6A:
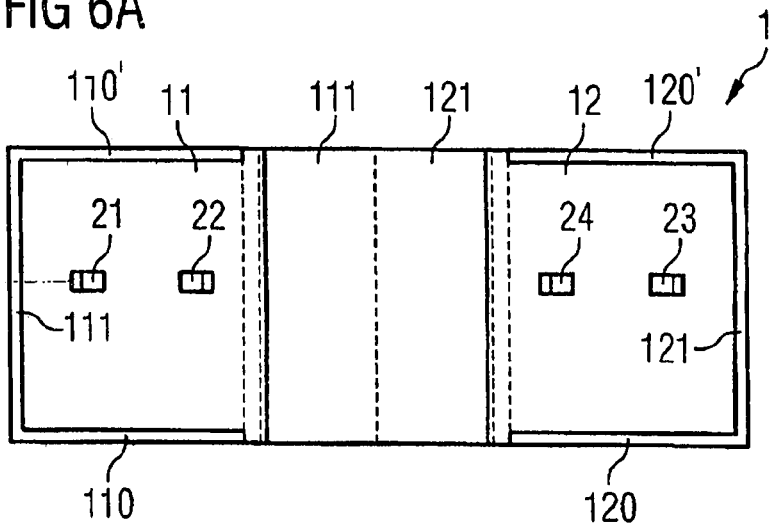
FIG. 6A, a top view of another holder according to the invention.
Figure 6B:
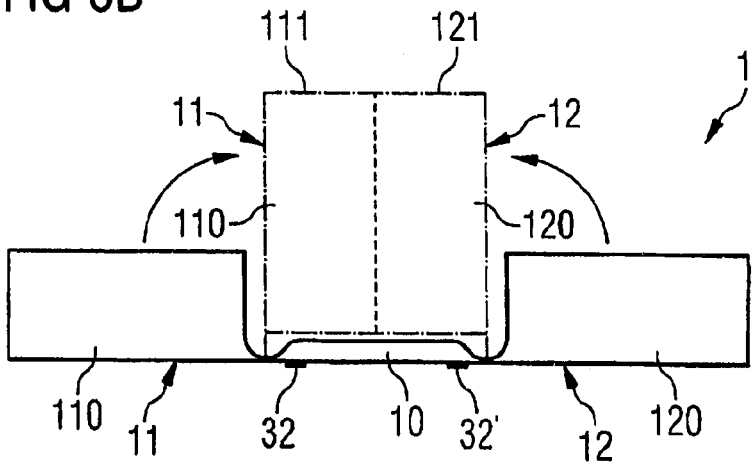
FIG. 6B, a side view of the holder according to FIG. 6A.
Figure 6C:
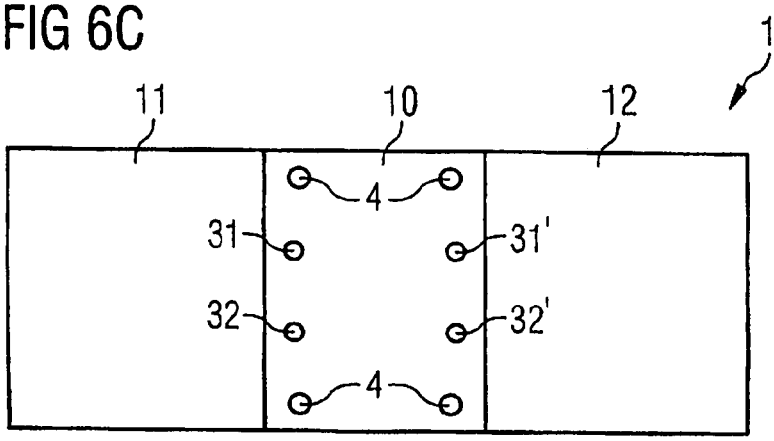
FIG. 6C, a bottom view of the holder according to FIGS. 6A and 6B.
Figure 6D:
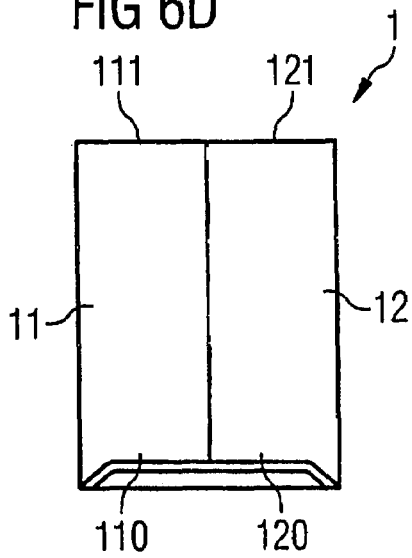
FIG. 6D, a side view of the holder according to FIGS. 6A to 6C in the direction parallel to the side lugs.
Figure 6E:
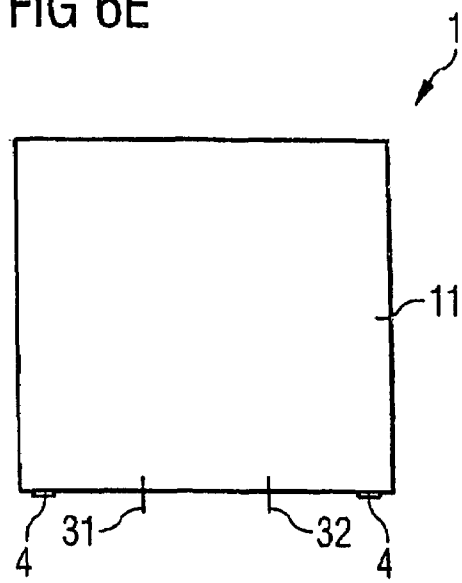
FIG. 6E, a front view of the holder according to FIGS. 6A to 6D in the direction perpendicular to the side lugs.
Figure 6F:
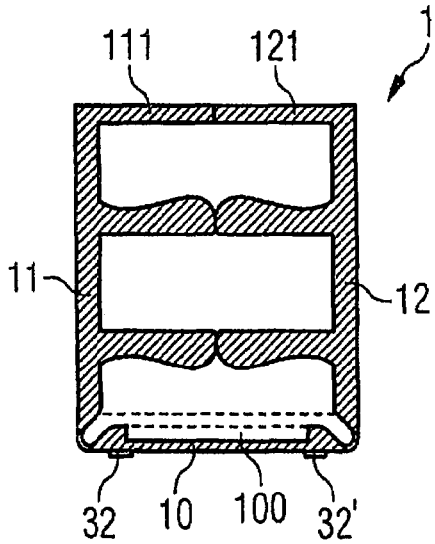
FIG. 6F, the holder according to the FIGS. 6A to 6E in a schematic cross section perpendicular to the side lugs.

FIG. 6A shows a schematic top view of the holder 1. FIGS. 6B and 6D show a schematic side view of the holder according to FIG. 6A. FIG. 6C shows a schematic bottom view of the holder 1. The FIG. 6D shows the side view of the holder 1 for the folded-together side lugs 11 and 12 in the direction parallel to the side lugs. In FIG. 6E, the front view of the holder according to FIGS. 6A to 6D is shown perpendicular to the side lug 11. FIG. 6F shows the cross-sectional view of the holder 1 for the cross section perpendicular to the side lugs.

In FIG. 6A it is to be seen that the side lug 11 is provided on three sides with the walls 110, 111, and 110'. The walls 110, 110' and 111 here stand perpendicular to the surface of the side lug 11. The side lug 11 forms a first half-shell together with the walls 110, 110', and 111. The walls 110 and 110' are the opposing end walls of the first half-shell. Wall 111 is the wall of the first half-shell facing upwards. The second side lug 12 is likewise provided with three walls 120, 120', and 121. The walls 120, 120' and 121 stand perpendicular to the surface of the side lug 12. The side lug 12, together with these side walls, forms a second half-shell, whose shape is preferably mirror-symmetric to the first half-shell. When the side lugs 11 and 12 are folded together, the walls 110 and 120, 110' and 120', 111 and 121 are turned towards each other.

The center part 10, the side lugs 11 and 12, the isolating bars 21 to 24, and the walls 110, 110', 111, 120, 120' and 121, are preferably formed together as one integral element.

In FIGS. 6D and 6F it is to be seen that when the side lugs 11 and 12 are folded over, the walls 111 and 121 (as well as 110 and 120) allocated to opposing side lugs touch each other.

In an embodiment of the invention proposed in FIG. 7, the opposing isolating bars 21 and 23 are provided with additional attachment devices 21*a* and 23*a* (here latch elements), wherein the isolating bars 21 and 23 of the different side lugs can be hooked to each other.

The invention is not limited to the embodiments shown here or to a particular selection of materials. The proposed elements can be combined with each other in any number and arrangements. The attachment devices for fixing the side lugs can also be clamping devices. The invention is also not limited to ring cores with a round cross section.

What is claimed is:

1. A holder for holding a ring-core choke with a ring core and at least two wire windings the holder comprising:

a center part; and hinged side lugs, each side lug being connected to the center part, each side lug featuring an isolating element to electrically isolate the wire windings on the ring core from one another;

wherein the side lugs are fixed in a folded-together state, respectively.

2. The holder according to claim 1, wherein the side lugs lie opposite each other and can be folded on both sides against the ring core.

3. The holder according to claim 1, wherein the side lugs are held parallel to each other by a part of the holder.

4. The holder according to claim 1, wherein the side lugs are held parallel to one another by the isolating elements.

5. The holder according to claim 1, wherein the respective isolating element features at least two isolating bars, the length of the isolating bars of the side lugs being selected so that they touch one another in the folded-together state.

6. The holder according to claim 5, wherein the isolating bars of opposing side lugs have corresponding attachment elements, the attachment elements being used for the fixing of the side lugs in the folded-together state.

7. The holder according to claim 6, wherein the attachment elements comprise clamp devices.

8. The holder according to claim 6, wherein the attachment devices comprise latch devices.

9. The holder according to claim 1, wherein a surface of the holder is made from an electrically insulating material.

10. The holder according to claim 1, wherein the center part includes openings for the passage of connections of the wire windings.

11. The holder according to claim 1, wherein the center part includes a recess for holding the ring-core choke.

12. The holder according to claim 1, wherein the side lugs, together with walls standing vertically on these lugs, form half-shells, with openings that point against each other in the folded-together state.

13. The holder according to claim 12, wherein when the side lugs are folded over, the walls allocated to opposing side lugs contact each other.

14. The holder according to claim 1, wherein each side lug and its respective isolating elements are formed together integrally.

15. An inductive component comprising the holder according to claim 1 in combination with a ring-core choke, the ring-core choke, having a magnetic ring core and at least two wire windings, wherein the wire windings are held at a distance from each other by the isolating elements.

16. The component according to claim 15, wherein the ring-core choke stands with its outer surface on the center part of the holder.

17. The component according to claim 15, wherein each isolating element features at least two isolating bars, wherein the isolating bars electrically isolate a respective wire winding from a closest other wire winding or windings.

18. The component according to claim 15, wherein the ring-core choke is mounted on the holder by an adhesive in a recess in the center part of the holder.

19. The component according to claim 15, wherein each isolating element features at least two isolating bars, wherein the isolating bars of the holder are inserted into a center opening of the ring-core choke, wherein the isolating bars touch the inner surface of the ring core in a spring-like way.

20. The component according to claim 15, wherein the holder substantially encloses the ring-core choke on all sides.

* * * * *